US006612787B1

(12) United States Patent
North et al.

(10) Patent No.: US 6,612,787 B1
(45) Date of Patent: Sep. 2, 2003

(54) CHROMIUM-CONTAINING CEMENTED TUNGSTEN CARBIDE COATED CUTTING INSERT

(75) Inventors: Bernard North, Greensburg, PA (US); Prem C. Jindal, Greensburg, PA (US)

(73) Assignee: Kennametal Inc., Latrobe, PA (US)

( * ) Notice: Subject to any disclaimer, the term of this patent is extended or adjusted under 35 U.S.C. 154(b) by 0 days.

(21) Appl. No.: 09/637,762

(22) Filed: Aug. 11, 2000

(51) Int. Cl.[7] ..... B23B 27/14; B26D 1/00

(52) U.S. Cl. ..... 407/119; 407/118

(58) Field of Search ..... 407/118, 119; 408/144, 145; 428/210, 212, 216, 323, 554

(56) References Cited

U.S. PATENT DOCUMENTS

| | | | | |
|---|---|---|---|---|
| 3,785,801 | A | 1/1974 | Benjamin | 75/0.5 BC |
| 4,168,957 | A | 9/1979 | Lee et al. | 51/309 |

(List continued on next page.)

FOREIGN PATENT DOCUMENTS

| | | |
|---|---|---|
| DE | 4000223 | 7/1993 |
| EP | 0685572 | 12/1995 |
| EP | 0792390 | 9/1997 |
| EP | 1038989 | 9/2000 |
| JP | 5487719 | 12/1979 |
| JP | 55120936 | 9/1980 |
| JP | 55-120936 | * 9/1980 |
| JP | 6330220 | 11/1994 |
| JP | 09207008 | 12/1997 |
| JP | 11197936 | 1/1998 |
| JP | 11300516 | 4/1998 |
| JP | 10219384 | 8/1998 |
| JP | 1121651 | 1/1999 |
| JP | 1161317 | 3/1999 |
| JP | 11221708 | 8/1999 |

OTHER PUBLICATIONS

US 5,143,488, 9/1992, Santhanam et al. (withdrawn)
Kennametal Lab Report K3567 on Iscar IC656 and unknown Sumitomo Tools (Jul., 1985).
Kennametal Lab Report on Kustom Machine & Tool Grade IT–110 (Jun., 2000).
Summary of Kennametal Lab Report on Bohlerit Grade R421 (Mar., 1989).
Summary of Kennametal Lab Report on Carolina Coatings Grade BC–1 (Apr., 1992).
Summary of Kennametal Lab Report on Mitsubishi Grade UC5005 (Dec., 1998).

(List continued on next page.)

*Primary Examiner*—Henry W. H. Tsai
(74) *Attorney, Agent, or Firm*—John J. Prizzi

(57) ABSTRACT

A chromium-containing coated cemented tungsten carbide cutting insert that has a substrate and a coating. The substrate comprises between about 5.7 and about 6.4 weight percent cobalt, between about 0.2 and about 0.8 weight percent chromium and the balance tungsten and carbon, and a coercive force of about 195 to 245 oersteds.

16 Claims, 2 Drawing Sheets

U.S. PATENT DOCUMENTS

| | | | | | |
|---|---|---|---|---|---|
| 4,277,283 | A | | 7/1981 | Tobioka et al. | 75/238 |
| 4,587,174 | A | * | 5/1986 | Yoshimura et al. | 428/552 |
| 4,610,931 | A | | 9/1986 | Nemeth et al. | 428/547 |
| 4,828,612 | A | | 5/1989 | Yohe | 75/238 |
| 4,830,930 | A | | 5/1989 | Taniguchi et al. | 428/547 |
| 4,913,877 | A | | 4/1990 | Yohe | 419/13 |
| 5,162,147 | A | * | 11/1992 | Ruppi | 428/216 |
| 5,181,953 | A | | 1/1993 | Nakano et al. | 75/237 |
| RE34,180 | E | | 2/1993 | Nemeth et al. | 428/547 |
| 5,188,489 | A | | 2/1993 | Santhanam et al. | 407/119 |
| 5,232,318 | A | * | 8/1993 | Santhanam et al. | 407/119 |
| 5,283,030 | A | | 2/1994 | Nakano et al. | 419/53 |
| 5,288,676 | A | | 2/1994 | Shimada et al. | 501/93 |
| 5,305,840 | A | | 4/1994 | Liang et al. | 175/426 |
| 5,310,605 | A | | 5/1994 | Baldoni, II et al. | 428/569 |
| 5,325,747 | A | | 7/1994 | Santhanam et al. | 82/1.11 |
| 5,364,209 | A | | 11/1994 | Santhanam et al. | 407/119 |
| 5,484,468 | A | | 1/1996 | Ostlund et al. | 75/236 |
| 5,597,272 | A | * | 1/1997 | Moriguchi et al. | 407/119 |
| 5,619,000 | A | | 4/1997 | Ederyd et al. | 75/240 |
| 5,665,431 | A | | 9/1997 | Narasimhan | 427/255 |
| 5,694,639 | A | | 12/1997 | Oskarsson et al. | 419/16 |
| 5,700,551 | A | * | 12/1997 | Kukino et al. | 428/212 |
| 5,722,803 | A | * | 3/1998 | Battaglia et al. | 407/119 |
| 5,729,823 | A | | 3/1998 | Gustafson et al. | 428/552 |
| 5,750,247 | A | * | 5/1998 | Bryant et al. | 428/323 |
| 5,776,588 | A | * | 7/1998 | Moriguchi et al. | 428/210 |
| 5,841,045 | A | | 11/1998 | McCandlish et al. | 75/236 |
| 5,920,760 | A | | 7/1999 | Yoshimura et al. | 428/551 |
| 5,942,318 | A | | 8/1999 | Söderberg et al. | 428/216 |
| 5,955,186 | A | | 9/1999 | Grab | 428/312.8 |
| 5,976,707 | A | | 11/1999 | Grab et al. | 428/547 |
| 5,984,593 | A | | 11/1999 | Bryant | 407/119 |
| 6,017,488 | A | | 1/2000 | Weinl et al. | 419/26 |
| 6,022,175 | A | | 2/2000 | Heinrich et al. | 407/119 |
| 6,250,855 | B1 | | 6/2001 | Persson et al. | 407/119 |

OTHER PUBLICATIONS

Summary of Kennametal Lab Report on North American Carbide NS326 (Apr., 1999).

Summary of Kennametal Lab Report on North American Carbide NS675 (Jul., 1994).

Kennametal Lab Report R4307 on North American Carbide NS675 (Jul., 1994).

Summary of Kennametal Lab Report on Plansee Grade TCC10 (Jan., 1996).

Summary of Kennametal Lab Report on Sumitomo, Igetaloy Grade AC 230 Jul., 1997–Nov., 1996).

Summary of Kennametal Lab Report on Sumitomo, Igetaloy Grade AC 304 (Nov., 1998).

Summary of Kennametal Lab Report on Sumitomo, Igetaloy Grade K153R2 (Feb., 1997).

Summary of Kennametal Lab Report on Toshiba Grade TD915 (Oct., 1998).

Kennametal Lab Report R4656 on Toshiba–Tungaloy Grade TD915 (Oct., 1998).

Summary of Kennametal Lab Report on Toshiba Grade T841 (Jul., 1992).

Summary of Kennametal Lab Report on Teledyne Firth Sterling Grade KM21 (Apr., 1994).

Summary of Kennametal Lab Report on Valenite W6–S7 (Jul., 1999).

PCT International Application No. PCT/US01/21170—International Search Report of Apr. 5, 2002.

PCT International Application No. PCT/US01/21166—International Search Report of Apr. 5, 2002.

English Abstract of JP5329703A, Surface Coated Cemented Carbide Cutting Tool (Dec. 1993).

Henjered et al., "Quantative microanalysis of carbide/carbide interfaces in WC–Co base cemented carbides", Materials Science and Technology vol. 2 (Aug. 1986) pp. 847–855.

Santhanam et al., An Advanced Cobalt–enriched Grade Designed to Enhance Machining Productivity, ASM's Int'l Conf on High Productivity Machining, Materials and Processing, New Orleans, LA 1985 Paper No. 8503–003 pp. 1–8.

ASTM Designation No. B276–91(Reapproved 1996), Standard Test Method for Apparent Porosity in Cemented Carbides (1996), pp. 1–6.

English Abstract of JP6212341A, Sintered Hard Alloy and Its Production (Jan. 1994).

English Abstract of JP7216492A, Hard Material and Its Production (Aug., 1995).

English Abstract of JP11221708A, Cemented–Carbide Miniature Drill with Excellent Abrasion Resistance (Aug. 1999).

English Abstract of JP9295205A, Throw Away Insert Made of Coated Cemented Carbide and Manufacture Thereof (Nov. 1997).

International Search Report PCT Patent Application U.S. 01/21156 (mailed Dec. 3, 2002).

Notification of Transmittal of the International Preliminary Examination Report mailed Sep. 16, 2002 in PCT/US01/21166.

International Preliminary Examination Report mailed Sep. 16, 2002 in PCT/US01/21166.

Written Opinion mailed Aug. 8, 2002 in PCT/US01/21170.

* cited by examiner

CHROMIUM-CONTAINING CEMENTED TUNGSTEN CARBIDE COATED CUTTING INSERT

FIELD OF THE INVENTION

The invention pertains to a chromium-containing cemented tungsten carbide body such as a cutting insert. While applicants contemplate other metalcutting applications, these cutting inserts are suitable for the machining (e.g., milling) of workpieces such as, for example, gray cast iron alloys.

BACKGROUND OF THE INVENTION

Among the metalcutting processes, milling places the most demands on the cutting insert. The cutting insert repeatedly enters, cuts and then exits the workpiece, and thus sustains repeated mechanical and thermal shocks. Thermal shocks and mechanical shocks can each result in microchipping of the cutting edge of the cutting insert.

While earlier coated cutting insert have satisfactory performance, it would be desirable to provide a coated cutting insert that has improved ability to able to withstand the mechanical shocks and thermal shocks of a machining application such milling. Although these coated cutting inserts may have application to metalcutting applications in general, they would have specific application to the milling of gray cast iron alloys.

SUMMARY OF THE INVENTION

In one form, the invention is a coated cutting insert that comprises a tungsten carbide-based substrate that has a rake surface and a flank surface, the rake surface and the flank surface intersect to form a substrate cutting edge. The substrate comprises between about 5.7 weight percent and about 6.4 weight percent cobalt, between about 0.2 weight percent and about 0.8 weight percent chromium, tungsten and carbon. There is a coating on the substrate wherein the coating includes a layer of alumina applied by chemical vapor deposition (CVD). Preferably, the substrate comprises at least 70 weight percent, and more preferably, at least 90 weight percent tungsten and carbon.

BRIEF DESCRIPTION OF THE DRAWINGS

The following is a brief description of the drawings that form a part of this patent application.

DETAILED DESCRIPTION OF THE INVENTION

Figure 1:
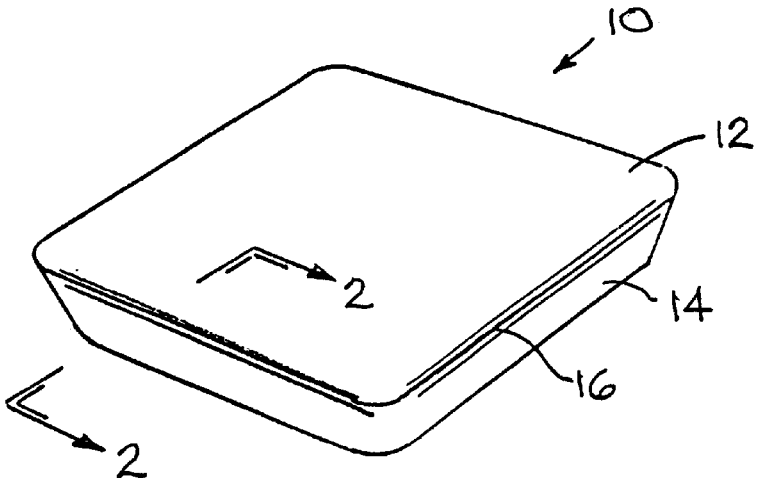
FIG. 1 is an isometric view of a specific embodiment of a cutting insert.
Figure 2:
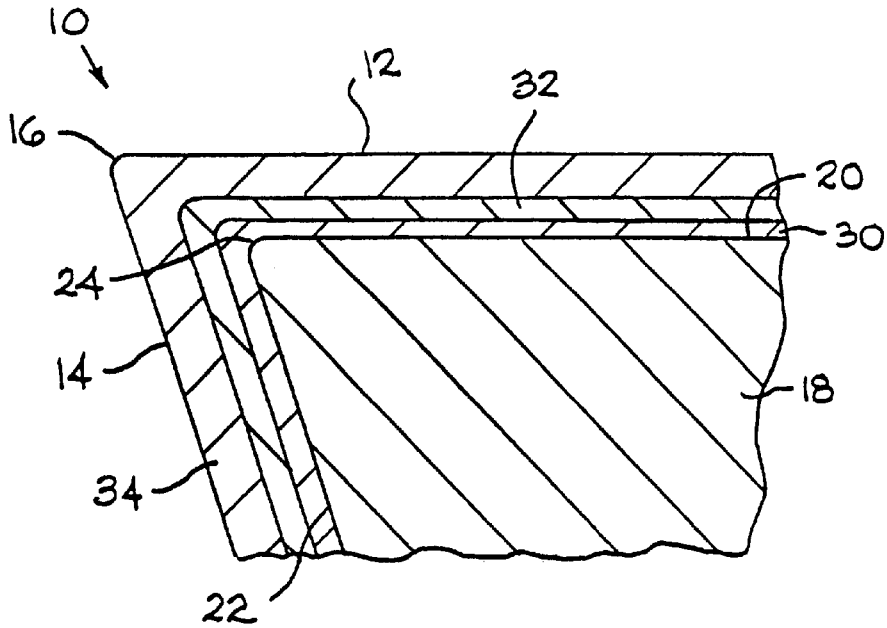
FIG. 2 is a cross-sectional view of the cutting insert of FIG. 1 taken along section 2—2 of FIG. 1 that illustrates a coating scheme in which there is a base coating layer, a mediate coating layer and an outer coating layer.

Referring to the drawings, FIGS. 1 and 2 illustrate a first specific embodiment of a cutting insert generally designated as 10. The cutting insert is made by typical powder metallurgical techniques. One exemplary process comprises the steps of ball milling (or blending) the powder components into a powder mixture, pressing the powder mixture into a green compact, and sintering the green compact so as to form an as-sintered substrate.

In the present embodiments the typical components of the starting powders comprise tungsten carbide, cobalt, and chromium carbide. As one option, carbon may be a component of the starting powder mixture to adjust the overall carbon content.

Cutting insert 10 has a rake face 12 and a flank face 14. The rake face 12 and the flank face 14 intersect to form a cutting edge 16. Cutting insert 10 further includes a substrate 18 that has a rake surface 20 and a flank surface 22. The rake surface 20 and the flank surface 22 of the substrate 18 intersect to form a substrate cutting edge 24.

Referring to the composition of the substrate, in one range the substrate may comprise between about 5.7 weight percent to about 6.4 weight percent cobalt, between about 0.2 weight percent to about 0.8 weight percent chromium, and at least 70 weight percent tungsten and carbon. In another range the substrate may comprise between about 5.9 weight percent to about 6.1 weight percent cobalt, between about 0.3 weight percent to about 0.7 weight percent chromium, and the balance comprising tungsten, and carbon. Optionally, titanium, tantalum, niobium, zirconium, hafnium and vanadium may also be present in the substrate.

Specific embodiments of the substrate of FIGS. 1 and 2 have a composition that comprises about 6.0 weight percent cobalt, about 0.4 or about 0.6 weight percent chromium and about 93.6 or 93.4 weight percent tungsten and carbon along with minor amounts of impurities. These specific embodiments of the substrate of FIG. 1 have the following physical properties: a hardness of about 91.7–92.6 Rockwell A, a coercive force ($H_c$) of about 195–245 oersteds (Oe), a magnetic saturation of about 133–149 gauss cubic centimeter per gram cobalt (gauss-$cm^3$/gm).

Cutting insert 10 has a coating scheme. The coating scheme includes a base coating layer 30 applied to the surfaces of the substrate 18, a mediate coating layer 32 applied to the base coating layer 30, and an outer coating layer 34 applied to the mediate coating layer 32. In the embodiment of the cutting insert of FIGS. 1 and 2, the base coating layer 30 comprises a layer of titanium carbonitride applied by conventional CVD and the mediate coating layer 32 comprises a layer of titanium carbide applied by conventional CVD so that the combined thickness of the base layer 30 and the mediate layer 32 equals 2.0 micrometers. The outer coating layer 34 comprises alumina applied by conventional CVD to a thickness of about 2.3 micrometers.

Applicants contemplate that an alternate multi-layer coating scheme for the specific embodiment of FIGS. 1 and 2 may comprise a base layer of titanium nitride applied to the surface of the substrate by conventional CVD to a thickness of 1.0 micrometers. A mediate layer of titanium carbonitride applied to the base layer by moderate temperature chemical vapor deposition (MTCVD) to a thickness of 2.0 micrometers. An outer layer of alumina applied to the mediate layer by conventional CVD to a thickness of about 2.0 micrometers.

Figure 3:
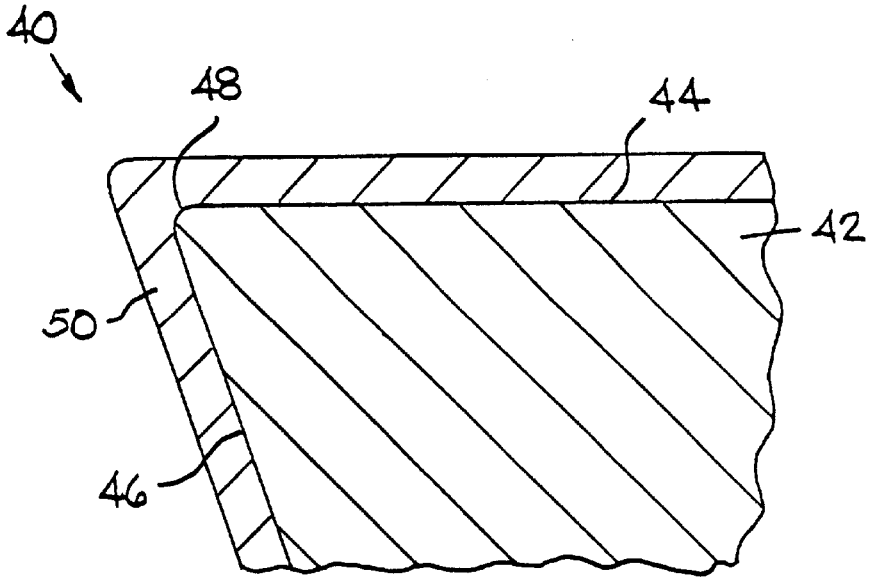
FIG. 3 is a cross-sectional view of a second embodiment of a cutting insert that shows a single coating layer.

FIG. 3 illustrates a cross-sectional view of a second specific embodiment of a cutting insert generally designated as 40. Cutting insert 40 comprises a substrate 42 that has a rake surface 44 and a flank surface 46. The rake surface 44 and the flank surface 46 intersect to form a substrate cutting edge 48. The composition of the substrate of the second specific embodiment of the cutting insert is the same as the composition of the substrate of the first specific embodiment of the cutting insert.

Cutting insert 40 has a single layer coating scheme comprising a layer 50 of titanium aluminum nitride applied to the surface of the substrate by physical vapor deposition (PVD). The coating layer 50 is of a thickness equal to about 3.5 micrometers.

In alternate embodiments, applicants contemplate that the base coating layer may comprise any one of the nitrides, carbides and carbonitrides of titanium, hafnium and zirconium and additional coating layers may comprise one or more of alumina and the borides, carbides, nitrides, and carbonitrides of titanium, hafnium and zirconium. These coating layers may be applied by any one or combination of CVD, physical vapor deposition (PVD) [e.g., titanium nitride, titanium carbonitride, titanium diboride, and/or titanium aluminum nitride], or moderate temperature chemical vapor deposition (MTCVD) [e.g., titanium carbonitride]. U.S. Pat. No. 5,272,014 to Leyendecker et al. and U.S. Pat. No. 4,448,802 to Behl et al. disclose PVD techniques. Each one of U.S. Pat. No. 4,028,142 to Bitzer et al. and U.S. Pat. No. 4,196,233 to Bitzer et al. discloses MTCVD techniques, which typically occur at a temperature between 500–900 degrees Centigrade.

The inventors believe that essentially all of the chromium is in the binder and that preferably during the CVD coating operation, chromium from the substrate diffuses into the base coating layer. The base coating layer is preferably one of the carbides, nitrides, or carbonitrides of titanium, hafnium, or zirconium. When during the CVD coating operation cobalt also diffuses into the base coating layer, the ratio of chromium to cobalt in atomic percent (Cr/Co ratio) in the base coating layer is greater than the Cr/Co ratio in the substrate. The inventors believe that diffusion of chromium during CVD coating (>900° C.) into the base layer coating from the substrate enhances coating adhesion during metalcutting and forms a chromium solid solution with the base layer material (e.g., a titanium chromium carbonitride or titanium tungsten chromium carbonitride) having improved wear resistance and adhesion.

Applicants' assignee is the assignee of co-pending United States patent application entitled CHROMIUM-CONTAINING CEMENTED CARBIDE BODY, and filed on the same day as this patent application (Kennametal Inc., U.S. Ser. No. 09/638,048. This co-pending patent application pertains to a chromium-containing cemented carbide body (e.g., tungsten carbide-based cemented carbide body) that has a surface zone of binder alloy enrichment.

Applicants' assignee is also the assignee of co-pending U.S. patent application entitled CHROMIUM-CONTAINING CEMENTED TUNGSTEN CARBIDE BODY, and filed on the same day as this patent application (Kennametal Inc., U.S. Ser. No. 09/637,280. This co-pending patent application pertains to a chromium-containing cemented carbide body (e.g., tungsten carbide-based cemented carbide body) that has a substrate that comprises between about 10.4 weight percent and about 12.7 weight percent cobalt, between about 0.2 weight percent and about 1.2 weight percent chromium, tungsten and carbon. There is a coating on the substrate.

Five milling tests (i.e., Milling Tests Nos. 1 through 5) were conducted to determine the performance of cutting inserts of the present invention as compared to other cutting inserts. A matrix of cutting inserts presenting fifteen different combinations of substrate compositions and coating compositions was tested in the milling of gray cast iron by Milling Tests Nos. 1 through 5. Table 1 below sets forth the compositions of the substrates that consist of Inventive Substrates Nos. 1 and 2, and Comparative Substrates A through C.

TABLE 1

Compositions of Inventive Substrates Nos. 1 and 2 and Comparative Substrates A through C

| Substrate | Cobalt (wt %) | Chromium (wt %) | Tantalum (wt %) | Balance* |
|---|---|---|---|---|
| Inventive No. 1 | 6% | 0.6% | 0% | 93.4% tungsten and Carbon |
| Inventive No. 2 | 6% | 0.4% | 0% | 93.6% tungsten and carbon |
| Comp. A | 6% | 0% | 3.3% | 90.7% tungsten and carbon |
| Comp. B | 6% | 0% | 0.6% | 93.4% tungsten and carbon |
| Comp. C | 6% | 0% | 0.3% | 93.7% tungsten and carbon |

*plus impurities

The coating schemes comprise a first coating scheme, a second coating scheme and a TiAlN coating scheme.

The first coating scheme comprises a base layer of titanium carbonitride applied by conventional CVD to the surface of the substrate and a mediate layer of titanium carbide applied by conventional CVD to the base layer so that the combined thicknesses of the base layer and the mediate layer equals 2.3 micrometers. The C994M coating scheme further includes an outer layer of alumina applied to the mediate layer by conventional CVD to a thickness of 2.3 micrometers.

The second coating scheme comprises a base layer of titanium nitride applied by conventional CVD to the surface of the substrate to a thickness of 1.0 micrometers, a mediate layer of titanium carbonitride applied to the base layer by moderate temperature chemical vapor deposition (MTCVD) to a thickness of 2.0 micrometers, and a outer layer of alumina applied to the mediate layer by conventional CVD to a thickness of 2.0 micrometers.

The TiAlN coating scheme comprises a single layer of titanium aluminum nitride applied to the surface of the substrate by PVD to a thickness of about 3.5 micrometers.

Flycut Milling Test No. 1 was performed on gray cast iron at the following parameters: a speed equal to about 900 surface feet per minute (sfm); a feed equal to 0.010 inches per tooth (ipt); an axial depth of cut (a.doc) equal to 0.1 inches and a radial depth of cut (r.doc) equal to 3 inches wherein the tool life criteria were 0.015 inches uniform flank wear (UFW) and 0.030 inches maximum flank wear (FW). The milling was done dry without a coolant. The cutting inserts were a SPG433 style of cutting insert with a 30 degree lead angle.

Table 2 presents the test results for Flycut Milling Tests No. 1 in the form of tool life in minutes, the standard deviation as a percentage of tool life, and the relative tool life as measured against Comparative Substrate A.

TABLE 2

Tool Life, Standard Deviation and Relative Tool Life For Milling Test No. 1

| Coating/ Substrate | Inventive 1 | Inventive 2 | Comp. A | Comp. B | Comp. C |
|---|---|---|---|---|---|
| First | 46.8 | 48.4 | 33.3 | — | 26.3 |
| Coating | [0%] | [±3%] | [±7] | | [±30%] |
| Scheme | (140%) | (145%) | (100%) | | (79%) |
| Second | 39.8 | 36.5 | 25.3 | 24.7 | 27.9 |
| Coating | [±6%] | [±5%] | [±7%] | [±10%] | [±9%] |
| Scheme | (157%) | (144%) | (100%) | (98%) | (110%) |
| TiAlN | 11.3 | 8.6 | 8.6 | — | 8.1 |
| | [0%] | [±29%] | [±22%] | | [±20%] |
| | (131%) | (100%) | (100%) | | (94) |

Flycut Milling Test No. 2 was performed on gray cast iron at the following parameters: a speed equal to about 900 surface feet per minute (sfm); a feed equal to 0.010 inches per tooth (ipt); and an axial depth of cut (a.doc) equal to 0.1 inches and a radial depth of cut (r.doc) equal to 3 inches wherein the tool life criteria were 0.015 inches uniform flank wear (UFW) and 0.030 inches maximum flank wear (FW). The milling was with flood coolant. The cutting inserts were a SPG433 style of cutting insert with a 30 degree lead angle.

Table 3 presents the test results for Flycut Milling Tests No. 2 in the form of tool life in minutes, the standard deviation as a percentage of the tool life, and the relative tool life as measured against Comparative Substrate A.

TABLE 3

Tool Life, Standard Deviation and Relative Tool Life For Milling Test No. 2

| Coating/ Substrate | Inventive 1 | Inventive 2 | Comp. A | Comp. B | Comp. C |
|---|---|---|---|---|---|
| First | 6.7 | 4.0 | 5.4 | — | 5.9 |
| Coating | [±18%] | [±35%] | [±17%] | | [±21%] |
| Scheme | (124%) | (74%) | (100%) | | (109%) |
| Second | — | 5.6 | 5.4 | — | 4.0 |
| Coating | | [±43%] | [±31%] | | [±20%] |
| Scheme | | (104%) | (100%) | | (74%) |
| TiAlN | 5.9 | 4.6 | 5.4 | 4.3 | 5.4 |
| | [±42%] | [±27%] | [±17%] | [±11%] | [±9%] |
| | (109%) | (85%) | (100%) | (80%) | (100%) |

Flycut Milling Test No. 3 was performed on gray cast iron at the following parameters: a speed equal to about 1200 surface feet per minute (sfm); a feed equal to 0.010 inches per tooth (ipt); and an axial depth of cut (a.doc) equal to 0.1 inches and a radial depth of cut (r.doc) equal to 3 inches wherein the tool life criteria were 0.015 inches uniform flank wear (UFW) and 0.030 inches maximum flank wear (FW). The milling was done dry without a coolant. The cutting inserts were a SPG433 style of cutting insert with a 30 degree lead angle.

Table 4 presents the test results for Flycut Milling Tests No. 3 in the form of tool life in minutes, the standard deviation as a percentage of the tool life, and the relative tool life as measured against Comparative Substrate A.

TABLE 4

Tool Life, Standard Deviation and Relative Tool Life For Milling Test No. 3

| Coating/ Substrate | Inventive 1 | Inventive 2 | Comp. A | Comp. B | Comp. C |
|---|---|---|---|---|---|
| First | 14.1 | 13.7 | 17.7 | 15.5 | 14.1 |
| Coating | [±32%] | [±27%] | [±36%] | [±32%] | [±25%] |
| Scheme | (80%) | (77%) | (100%) | (88%) | (80%) |
| Second | 12.1 | 12.1 | 12.5 | 13.5 | 14.3 |
| Coating | [±20%] | [±10%] | [±6%] | [±11%] | [±9%] |
| Scheme | (97%) | (97%) | (100%) | (108%) | (114%) |
| TiAlN | — | 5.6 | 4.4 | 4.6 | — |
| | | [±22%] | [±32%] | [±27%] | |
| | | (127%) | (100%) | (105%) | |

Flycut Milling Test No. 4 was performed on gray cast iron at the following parameters: a speed equal to about 900 surface feet per minute (sfm); a feed equal to 0.010 inches per tooth (ipt); and an axial depth of cut (a.doc) equal to 0.1 inches and a radial depth of cut (r.doc) equal to 3.5 inches wherein the tool life criteria were 0.015 inches uniform flank wear (UFW) and 0.030 inches maximum flank wear (FW). The milling was done dry without a coolant. The cutting inserts were a SPG433 style of cutting insert with a 30 degree lead angle.

Table 5 presents the test results for Flycut Milling Tests No. 4 in the form of tool life in minutes, the standard deviation as a percentage of the tool life, and the relative tool life as measured against Comparative Substrate A.

TABLE 5

Tool Life, Standard Deviation and Relative Tool Life For Milling Test No. 4

| Coating/ Substrate | Inventive 1 | Inventive 2 | Comp. A | Comp. B | Comp. C |
|---|---|---|---|---|---|
| First | 14.4 | 12.6 | 13.0 | 11.2 | 10.2 |
| Coating | [±20%] | [±11%] | [±27%] | [±13%] | [±34%] |
| Scheme | (111%) | (97%) | (100%) | (86%) | (78%) |
| Second | 15.8 | — | 13.0 | 13.0 | — |
| Coating | [±10%] | | [±27] | [±16%] | |
| Scheme | (122%) | | (100%) | (100%) | |
| TiAlN | 12.6 | 12.1 | 12.1 | — | 9.8 |
| | [±40%] | [±37%] | [±29%] | | [±38%] |
| | (104%) | (100%) | (100%) | | (81%) |

Flycut Milling Test No. 5 was performed at the following parameters: a speed equal to about 900 surface feet per minute (sfm); a feed equal to 0.010 inches per tooth (ipt); and an axial depth of cut (a.doc) equal to 0.1 inches and a radial depth of cut (r.doc) equal to 3.5 inches wherein the tool life criteria were 0.015 inches uniform flank wear (UFW) and 0.030 inches maximum flank wear (FW). The milling was done with flood coolant. The cutting inserts were a SPG433 style of cutting insert with a 30 degree lead angle.

Table 6 presents the test results for Flycut Milling Tests No. 5 in the form of tool life in minutes, the standard deviation as a percentage of the tool life, and the relative tool life as measured against Comparative Substrate A.

TABLE 6

Tool Life, Standard Deviation and Relative Tool Life For Milling Test No. 5

| Coating/ Substrate | Inventive 1 | Inventive 2 | Comp. A | Comp. B | Comp. C |
|---|---|---|---|---|---|
| First Coating Scheme | 4.2 [±17%] (105%) | 3.5 [±0%] (88%) | 4.0 [±20%] (100%) | 4.2 [±33%] (105%) | 4.0 [±10%] (100%) |
| Second Coating Scheme | — | 4.2 [±29%] (114%) | 3.7 [±11%] (100%) | — | 3.5 [±20%] (95%) |
| TiAlN | 2.9 [±18%] (73%) | 3.7 [±20%] (93%) | 4.0 [±10%] (100%) | 3.3 [±25%] (83%) | 3.5 [±20%] (88%) |

The patents and other documents identified herein are hereby incorporated by reference herein.

Other embodiments of the invention will be apparent to those skilled in the art from a consideration of the specification or a practice of the invention disclosed herein. It is intended that the specification and examples are illustrative only and are not intended to be limiting on the scope of the invention. The true scope and spirit of the invention is indicated by the following claims.

What is claimed is:

1. A coated cutting insert comprising:

a tungsten carbide-based substrate having a rake surface and a flank surface, the rake surface and the flank surface intersect to form a substrate cutting edge;

the substrate comprising tungsten and carbon and between about 5.7 weight percent and about 6.4 weight percent cobalt, between about 0.2 weight percent and about 0.8 weight percent chromium, and having a coercive force ($H_c$) of about 195 to 245 oersteds; and a coating on the substrate wherein the coating includes a layer of alumina applied by chemical vapor deposition;

wherein the coating includes a base coating layer containing chromium wherein the chromium diffuses from the substrate during the coating process.

2. The coated cutting insert according to claim 1 wherein the substrate comprises between about 5.9 weight percent and about 6.1 weight percent cobalt and between about 0.3 weight percent and about 0.7 weight percent chromium.

3. The coated cutting insert according to claim 1 wherein the substrate comprises about 5.0–6.1 weight percent cobalt, about 0.40–0.6 weight percent chromium.

4. The coated cutting insert according to claim 3 wherein the substrate comprises at least about 90 weight percent tungsten and carbon.

5. The coated cutting insert according to claim 1 wherein the substrate having a coercive force of about 220 oersteds.

6. The coated cutting insert according to claim 1 wherein the substrate having a hardness of between about 91.7 and about 92.6 Rockwell A, a magnetic saturation of between about 133 and about 149 gauss cubic centimeter per gram cobalt.

7. The coated cutting insert according to claim 1 wherein the base coating layer includes cobalt, and the ratio of chromium to cobalt in atomic percent (Cr/Co ratio) in the base layer being greater than the Cr/Co ratio in the substrate.

8. A coated cutting insert comprising:

a tungsten carbide-based substrate having a rake surface and a flank surface, the rake surface and the flank surface intersect to form a substrate cutting edge;

the substrate comprising tungsten and carbon and between about 5.7 weight percent and about 6.4 weight percent cobalt, between about 0.2 weight percent and about 0.8 weight percent chromium, and having a coercive force ($H_c$) of about 195 to 245 oersteds;

a coating on the substrate wherein the coating includes a layer of alumina applied by chemical vapor deposition;

the coating comprising a base layer of titanium carbonitride applied by chemical vapor deposition to the substrate, a mediate layer of titanium carbide applied to the base layer by chemical vapor deposition, and an outer layer of alumina applied to the mediate layer by chemical vapor deposition;

the base layer and the mediate layer have a combined thickness of about 2 micrometers;

the outer coating layer having a thickness of about 2.3 micrometers; and wherein the base layer containing chromium wherein the chromium diffuses from the substrate during the coating process.

9. The coated cutting insert according to claim 8 wherein the base layer includes cobalt, and the ratio of chromium to cobalt in atomic percent (Cr/Co ratio) in the base layer being greater than the Cr/Co ratio in the substrate.

10. A coated cutting insert comprising:

a tungsten carbide-based substrate having a rake surface and a flank surface, the rake surface and the flank surface intersect to form a substrate cutting edge;

the substrate comprising tungsten and carbon and between about 5.7 weight percent and about 6.4 weight percent cobalt, between about 0.2 weight percent and about 0.8 weight percent chromium, and having a coercive force ($H_c$) of about 195 to 245 oersteds;

a coating on the substrate wherein the coating includes a layer of alumina applied by chemical vapor deposition;

the coating comprising a base layer of titanium nitride applied to the substrate by chemical vapor deposition, a mediate layer of titanium carbonitride applied to the base layer by moderate temperature chemical vapor deposition, and an outer layer of alumina applied to the mediate layer by chemical vapor deposition;

the base layer has a thickness of less than 1 micrometers, the mediate layer has a thickness of about 2.0 micrometers, and the outer layer having a thickness of 2.0 micrometers; and wherein the base layer contains chromium wherein the chromium diffuses from the substrate during the coating process.

11. The coated cutting insert according to claim 10 wherein the base layer includes cobalt, and the ratio of chromium to cobalt in atomic percent (Cr/Co ratio) in the base layer being greater than the Cr/Co ratio in the substrate.

12. A coated cutting insert comprising:

a tungsten carbide-based substrate having a rake surface and a flank surface, the rake surface and the flank surface intersect to form a substrate cutting edge;

the substrate comprising tungsten and carbon and between about 5.7 weight percent and about 6.4 weight percent cobalt between about 0.2 weight percent and about 0.8 weight percent chromium, and having a coercive force ($H_c$) of about 195 to 245 oersteds;

a coating on the substrate wherein the coating includes a layer of alumina applied by chemical vapor deposition;

the coating comprising a base layer of titanium chromium carbonitride wherein the chromium diffuses from the substrate during the coating process.

13. A coated cutting insert comprising:

a tungsten carbide-based substrate having a rake surface and a flank surface, the rake surface and the flank surface intersect to form a substrate cutting edge;

the substrate comprising tungsten and carbon and between about 5.7 weight percent and about 6.4 weight percent cobalt, between about 0.2 weight percent and about 0.8 weight percent chromium, and having a coercive force ($H_c$)of about 195 to 245 oersteds; and a coating on the substrate wherein the coating includes a base layer containing titanium applied by chemical vapor deposition, and the base layer further including chromium wherein the chromium diffuses from the substrate during the coating process.

14. The coated cutting insert according to claim 13 wherein there is an absence of tantalum in the substrate.

15. A coated cutting insert comprising:

a tungsten carbide-based substrate having a rake surface and a flank surface, the rake surface and the flank surface intersect to form a substrate cutting edge;

the substrate comprising tungsten and carbon and between about 5.7 weight percent and about 6.4 weight percent cobalt, between about 0.2 weight percent and about 0.8 weight percent chromium, and having a coercive force ($H_c$) of about 195 to 245 oersteds;

a coating on the substrate wherein the coating includes a layer of alumina applied by chemical vapor deposition;

wherein there is an absence of tantalum in the substrate.

16. A coated cutting insert comprising:

a tungsten carbide-based substrate having a rake surface and a flank surface, the rake surface and the flank surface intersect to form a substrate cutting edge;

the substrate comprising tungsten and carbon and between about 5.7 weight percent and about 6.4 weight percent cobalt, between about 0.2 weight percent and about 0.8 weight percent chromium, and having a coercive force ($H_c$) of about 195 to 245 oersteds;

a coating on the substrate wherein the coating includes a layer of alumina applied by chemical vapor deposition;

wherein there is an absence of tantalum in the substrate.

* * * * *